US009457225B2

(12) United States Patent
Lagree

(10) Patent No.: US 9,457,225 B2
(45) Date of Patent: Oct. 4, 2016

(54) EXERCISE MACHINE CABLE ADJUSTMENT SYSTEM

(71) Applicant: SPX Fitness, Inc., Burbank, CA (US)

(72) Inventor: Sebastien Anthony Louis Lagree, West Hollywood, CA (US)

(73) Assignee: SPX Fitness, Inc., Burbank, CA (US)

( * ) Notice: Subject to any disclaimer, the term of this patent is extended or adjusted under 35 U.S.C. 154(b) by 221 days.

(21) Appl. No.: 14/543,407

(22) Filed: Nov. 17, 2014

(65) Prior Publication Data

US 2015/0072841 A1 Mar. 12, 2015

Related U.S. Application Data

(63) Continuation-in-part of application No. 13/924,088, filed on Jun. 21, 2013, now Pat. No. 9,119,989.

(60) Provisional application No. 61/719,757, filed on Oct. 29, 2012, provisional application No. 61/905,503, filed on Nov. 18, 2013.

(51) Int. Cl.

| | |
|---|---|
| ***A63B 21/068*** | (2006.01) |
| ***A63B 22/00*** | (2006.01) |
| ***A63B 21/04*** | (2006.01) |
| ***A63B 21/00*** | (2006.01) |
| ***A63B 23/035*** | (2006.01) |
| ***A63B 23/12*** | (2006.01) |
| *A63B 21/02* | (2006.01) |
| *A63B 21/055* | (2006.01) |

(52) U.S. Cl.

CPC ..... *A63B 22/0089* (2013.01); *A63B 21/0428* (2013.01); *A63B 21/154* (2013.01); *A63B 21/4035* (2015.10); *A63B 23/03533* (2013.01); *A63B 23/1209* (2013.01); *A63B 21/023* (2013.01); *A63B 21/0552* (2013.01); *A63B 2225/09* (2013.01)

(58) Field of Classification Search

CPC ..... A63B 2208/0252; A63B 22/0233; A63B 22/0087; A63B 21/00047; A63B 21/0428; A63B 21/068; A63B 21/0557; A63B 23/0211

See application file for complete search history.

(56) References Cited

U.S. PATENT DOCUMENTS

| | | | | |
|---|---|---|---|---|
| 339,638 | A * | 4/1886 | Goldie | A63B 21/068 482/96 |
| 3,658,327 | A * | 4/1972 | Thiede | A63B 21/068 182/116 |
| 4,101,124 | A * | 7/1978 | Mahnke | A63B 21/068 482/145 |
| 5,066,005 | A * | 11/1991 | Luecke | A63B 21/4029 482/130 |
| 7,803,095 | B1 | 9/2010 | Lagree | |
| 8,641,585 | B2 | 2/2014 | Lagree | |

* cited by examiner

*Primary Examiner* — Loan H Thanh
*Assistant Examiner* — Rae Fischer
(74) *Attorney, Agent, or Firm* — Neustel Law Offices; Michael S. Neustel

(57) ABSTRACT

An exercise machine cable adjustment system for providing efficient adjustment of the effective length of one or more cables. The exercise machine cable adjustment system generally includes a frame, a carriage movably positioned upon the frame and a pair of cables adjustably connected to the carriage to allow for adjustment of the effective length for each of the cables.

37 Claims, 9 Drawing Sheets

EXERCISE MACHINE CABLE ADJUSTMENT SYSTEM

CROSS REFERENCE TO RELATED APPLICATIONS

I hereby claim benefit under Title 35, United States Code, Section 120 of U.S. patent application Ser. No. 13/924,088 filed Jun. 21, 2013. This application is a continuation-in-part of the Ser. No. 13/924,088 application. The Ser. No. 13/924,088 application is currently pending and claims priority to U.S. Provisional Patent Application No. 61/719,757. The Ser. No. 13/924,088 application is hereby incorporated by reference into this application.

I hereby claim benefit under Title 35, United States Code, Section 119(e) of U.S. provisional patent application Ser. No. 61/719,757 filed Oct. 29, 2012. The 61/719,757 application is hereby incorporated by reference into this application.

I hereby claim benefit under Title 35, United States Code, Section 119(e) of U.S. provisional patent application Ser. No. 61/905,503 filed Nov. 18, 2013. The 61/905,503 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an exercise machine and more specifically it relates to an exercise machine cable adjustment system for providing efficient adjustment of the effective length of one or more cables.

2. Description of the Related Art

Any discussion of the related art throughout the specification should in no way be considered as an admission that such related art is widely known or forms part of common general knowledge in the field.

Exercise machines have been in use for many years. One common exercise machine that has enjoyed increasing popularity is the Pilates machine. A conventional Pilates machine generally includes a frame, a track extending across the frame, one or more platforms at the end of the frame, one or more handles extending from the frame, a carriage movably connected to the track, one or more biasing members (e.g. springs, elastic bands) connected between the frame and the carriage to apply a resistance biasing force to the carriage, and a pair of cables with handles connected to the carriage via pulleys. An individual positions their body upon the carriage and then grasps the handles of the cables to pull themselves along with the carriage towards an end of the exercise machine. Moving the carriage away from the end of the frame towards the opposite end of the frame results in the biasing members applying the resistance biasing force which therapeutic or fitness exercises can be effectively performed. U.S. Pat. Nos. 7,803,095 and 8,641,585 to Sebastien Lagree both disclose exemplary exercise machines suitable for Pilates exercises and additional exercises.

One of the core principles for Pilates is control. "Contrology" was Joseph Pilates' preferred name for his method. All Pilates exercises should be performed with authoritative control of the muscles working to lift against gravity as well as the resistance of the springs, thereby controlling the movement of the body and the apparatus.

Another core principle in Pilates is centering. For exercisers to fully control their bodies, they must have a starting place: the center. The center is the focal point of the Pilates Method, and incorporates the major centering muscle groups, such as abdominal and back muscles, gluteal and lower back muscles, hips, and inner thighs. Centering also requires central placement on the apparatus.

Yet another founding principle in Pilates is precision. Precision is essential to correctly practicing the Pilates methods. Without concentration on performing movements with precision each time, and with each exercise repetition on a Pilates apparatus, all the vital benefits of their Pilates routine will be lost.

One key advantage of the Pilates method over other forms of exercise is that throughout an entire session, and more importantly, throughout the lifelong practicing of Pilates, exercisers perform smooth, flowing exercise forms, and do not experience the damaging effects of exercises such as running that subjects the exerciser to continual spinal and joint impact, or weight power lifting that often strains and injures joints, muscles and connective tissue. In some instances, contemporary Pilates apparatuses incorporate various accessories that allow for the performance of exercises that cannot be reasonably performed on traditional apparatuses, for instance foot bars, handles, and cable and pulley systems. Although many contemporary accessories were not components of Joseph Pilates original apparatuses nearly 100 years ago, the addition of such accessories must remain true to the design principles that allow the Pilates method to be performed with control, centering, and precision.

Therefore, contemporary accessories that are incorporated into a Pilates apparatus must not only support the tenets of the Pilates method, but must also maximize user safety by minimizing injury to joints, muscles and connective tissue. In some instances, cables and pulleys are arranged on a Pilates apparatus to allow for the performance of pulling exercises. Handles attached to cables allow exercisers to use their arms to overcome the spring resistance force, thereby exercising shoulders, upper back, chest muscles, and arm muscles. Foot straps attached to cables allow exercisers to overcome the spring resistance through leg movements, for instance, leg adductor and abductor exercises that exercise the inner and outer thigh muscles.

Cables and pulleys are nearly always arranged in pairs such that an exerciser can grasp one handle in each hand, and work the arms simultaneously. By pulling on the handles, the exerciser can start, perform, and finish the exercises of the left and right arms in mirror fashion.

There are many factors unforeseen and unpredictable that cause a pair of pull cables on a Pilates apparatus to be unequal lengths. More specifically, a pull cable of a Pilates apparatus is preferably described as a pull cable assembly, comprising a first connector affixed to a first end of the cable allowing the cable to be attached to the Pilates apparatus, a length of cable, a second connector affixed to a second end of the cable, and a gripping handle or foot strap attached to the second connector.

In some cases, connectors simply break, and the Pilates instructor will find other connectors within the facility, and conduct a fast repair. For instance, a large oblong carabineer connector may be replaced with a short hook in order to return the apparatus to operational status.

In other cases, prolonged use of the pull cables will cause the cables to stretch in length, or fray where the cables pass through pulleys. Cables in disrepair are replaced with new cables, and often, only the most badly damaged cable of a pair of cables is replaced. After replacement, the new cable is not stretched to the same length as the older cable, causing the cables to be different lengths.

In yet other practical circumstances, a handle attached to one cable may break or come into disrepair. Over time, Pilates studios amass an inventory of spare parts scavenged from other apparatuses, and will find an acceptable replacement handle, although not of original equipment design. There is no dimensional standard for pull cable handles, therefore there is high likelihood that the replacement handle has a pull length different from the original equipment handle.

Still further, even if purchased from the original equipment manufacturer at a later date, subcontracted manufacturers' tolerances, engineering changes for cost reduction or reliability improvements, or material changes typically mean that replacement parts are not exact replicas of the original equipment, usually resulting in a total pull cable assembly length that is different from the pull cables installed on the Pilates apparatus.

Each and every one of these disadvantages to pull cable assemblies of a Pilates apparatus are well known in the industry, and each can result in different functional lengths of the two pull cables on one Pilates apparatus.

In each of these cases where exercisers are performing Pilates exercises on an apparatus with different length cables, exercisers are forced into positions that violate each of the foundational Pilates principles of control, centering and precision. Even a slightly modified position that the body naturally assumes to adjust to the different length cables subjects the muscles, joints and connective tissue on one side of the body to more force than the opposite side of the body. The additional and unbalanced force can cause injury to the exerciser.

Unequal length pull cable assemblies creates forces against the spring resistance that are biased towards one side of the body rather than balancing the forces equally, or cause the left and right hands, or left and fight feet to be positioned at different locations when the left and right sides are exerting equal forces against the resistance.

Further, use of pull cables of unequal lengths that bias forces unequally on the body can result injury. Still further, applying unequal forces on the outside corners of the slidable carriage of a Pilates apparatus can cause skewing of the carriage on the parallel rails, thereby causing accelerated or excessive wear on rollers and rails.

Those skilled in the art will immediately appreciate the need for, and the significant commercial value of a novel an improved cable and pulley system of a Pilates apparatuses that incorporate a fast, precise method of evening cable lengths such that the user can remain centered and in precise control throughout an exercise on the apparatus, and further ensures that the resistance force is balanced evenly between the first and left sides of the body.

BRIEF SUMMARY OF THE INVENTION

The invention generally relates to an exercise machine cable adjustment system which includes a frame, a carriage movably positioned upon the frame and a pair of cables adjustably connected to the carriage to allow for adjustment of the effective length for each of the cables.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
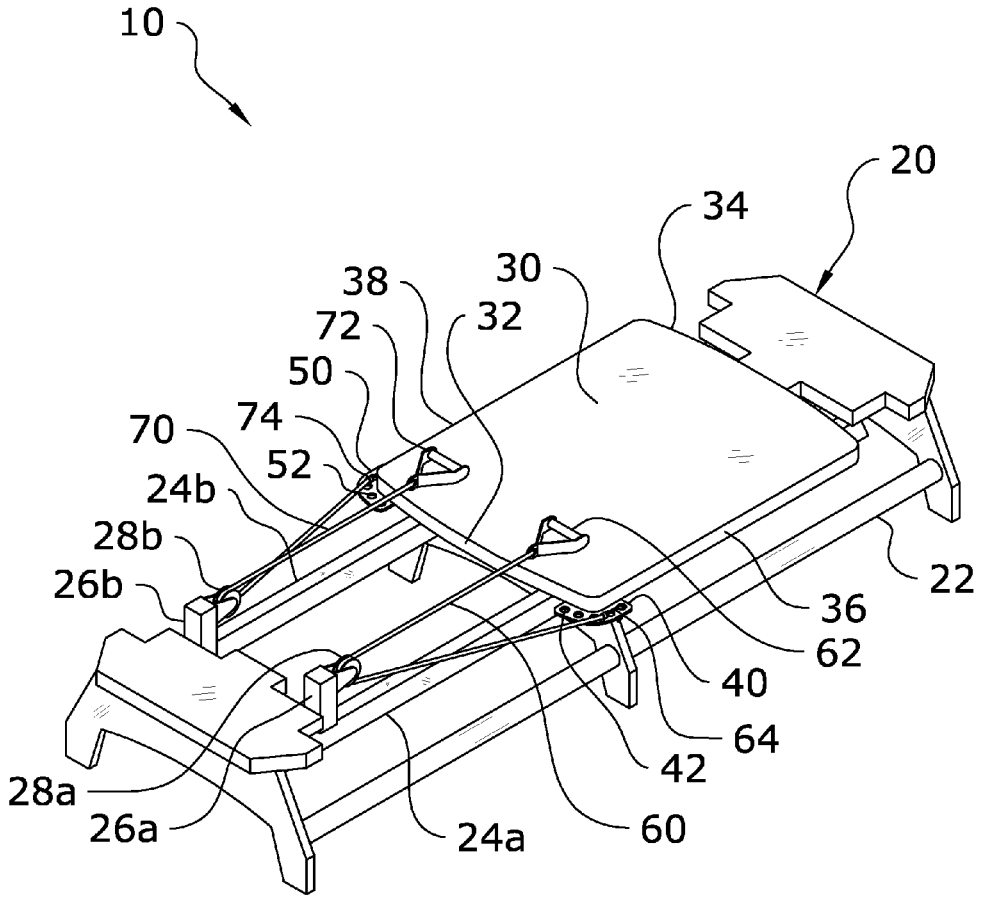
FIG. 1 is an upper perspective view of the present invention.

Turning now descriptively to the drawings, in which similar reference characters denote similar elements throughout the several views, FIGS. 1 through 8 illustrate an exercise machine cable adjustment system 10, which comprises a frame 22, a carriage 30 movably positioned upon the frame 22 and a pair of cables adjustably connected to the carriage 30 to allow for adjustment of the effective length for each of the cables.

B. Exercise Machine

FIGS. 1, 2, 6, 7 and 8 best illustrate the exercise machine 20. As illustrated in FIGS. 1, 2, 6, 7 and 8, the exercise machine 20 includes a frame 22 having a first distal end and a second distal end opposite of the first distal end. The frame 22 is comprised of an elongated structure having a longitudinal axis extending between the first distal end and the second distal end. The frame 22 may include one or more stationary platforms at the distal ends thereof as shown in FIGS. 1, 2, 6, 7 and 8.

The frame 22 includes one or more support rails 24*a-b* that extend along the length of the frame 22 to movably support the carriage 30. The support rails 24*a-b* are preferably parallel with respect to the longitudinal axis of the frame 22 and spaced apart from one another. The carriage 30 may include roller that slidably support the carriage 30 upon the support rails 24*a-b* thereby allowing the individual exercising to move the carriage 30 back and forth between the distal ends of the frame 22. One or more biasing members 21 (e.g. springs, elastic bands, actuators) extend between one end of the frame 22 and the carriage 30 to provide a biasing force to the carriage 30 during an exercise movement.

U.S. Pat. Nos. 7,803,095 and 8,641,585 to Sebastien Lagree both disclose exemplary exercise machines 20 suitable for Pilates exercises and are hereby incorporated by reference herein.

C. Carriage

Figure 3:
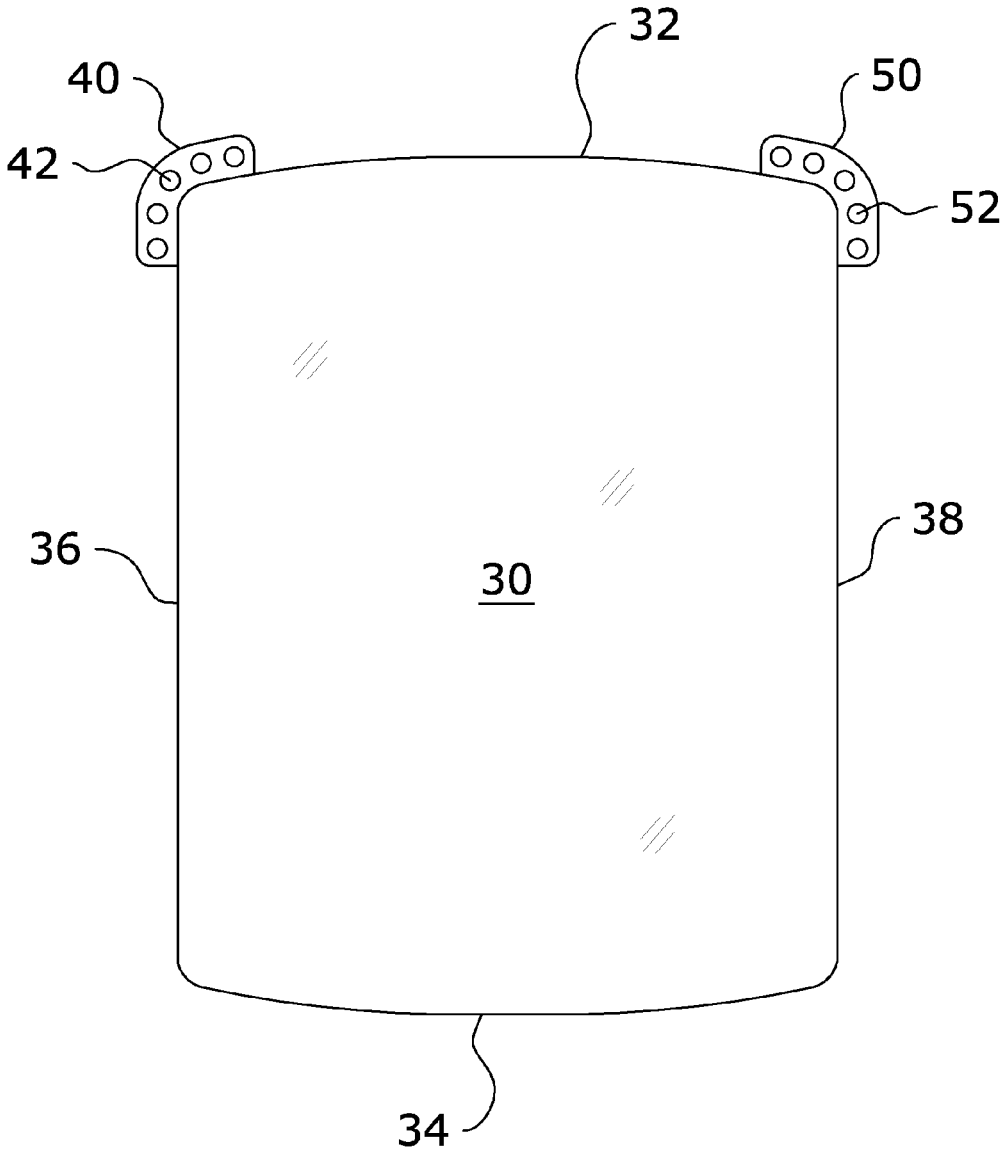
FIG. 3 is a top view of the carriage with the connectors for adjusting the effective length of the cables.
Figure 4:
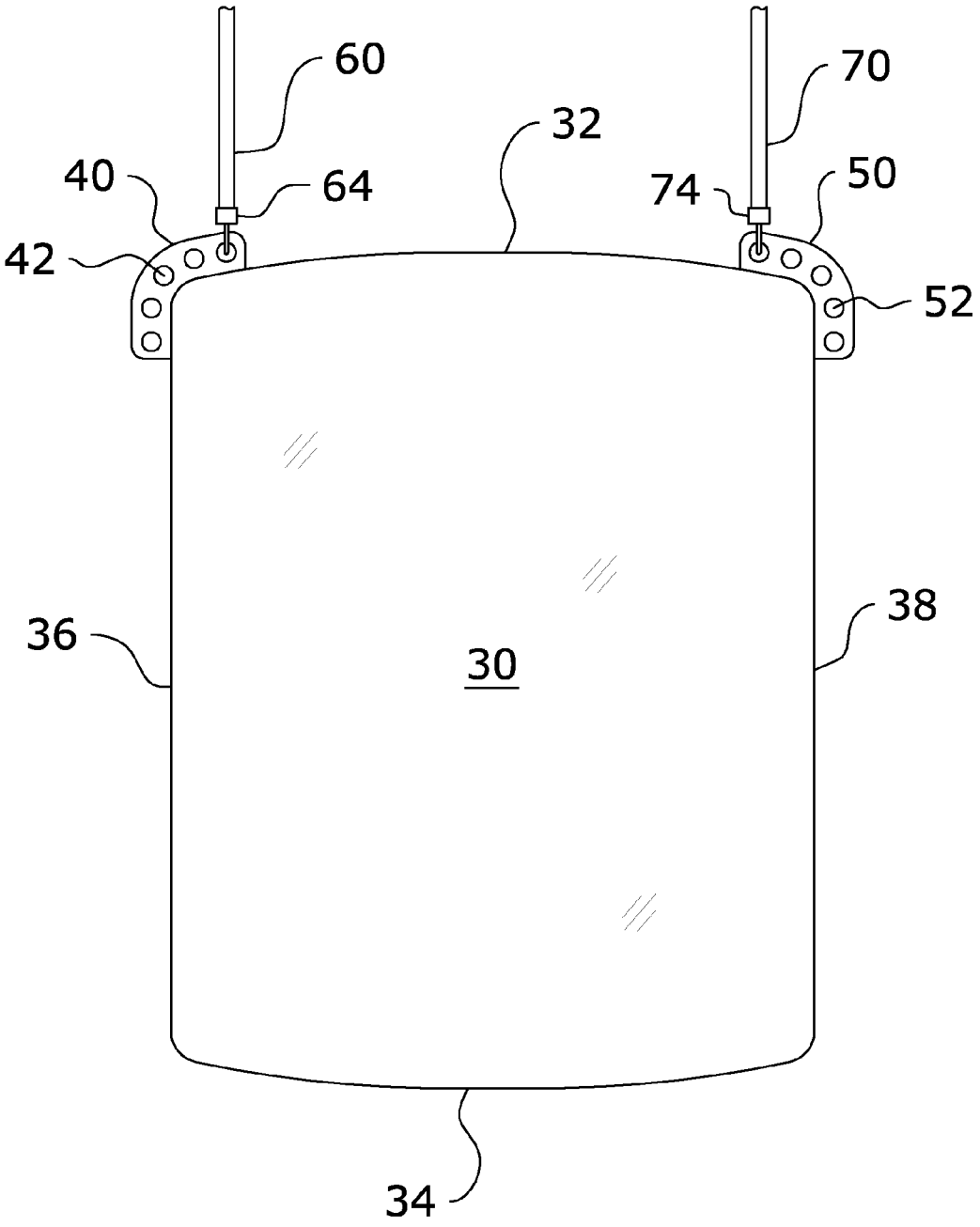
FIG. 4 is a top view of the carriage with both cables connected to the shortest length position on the connectors.
Figure 5:
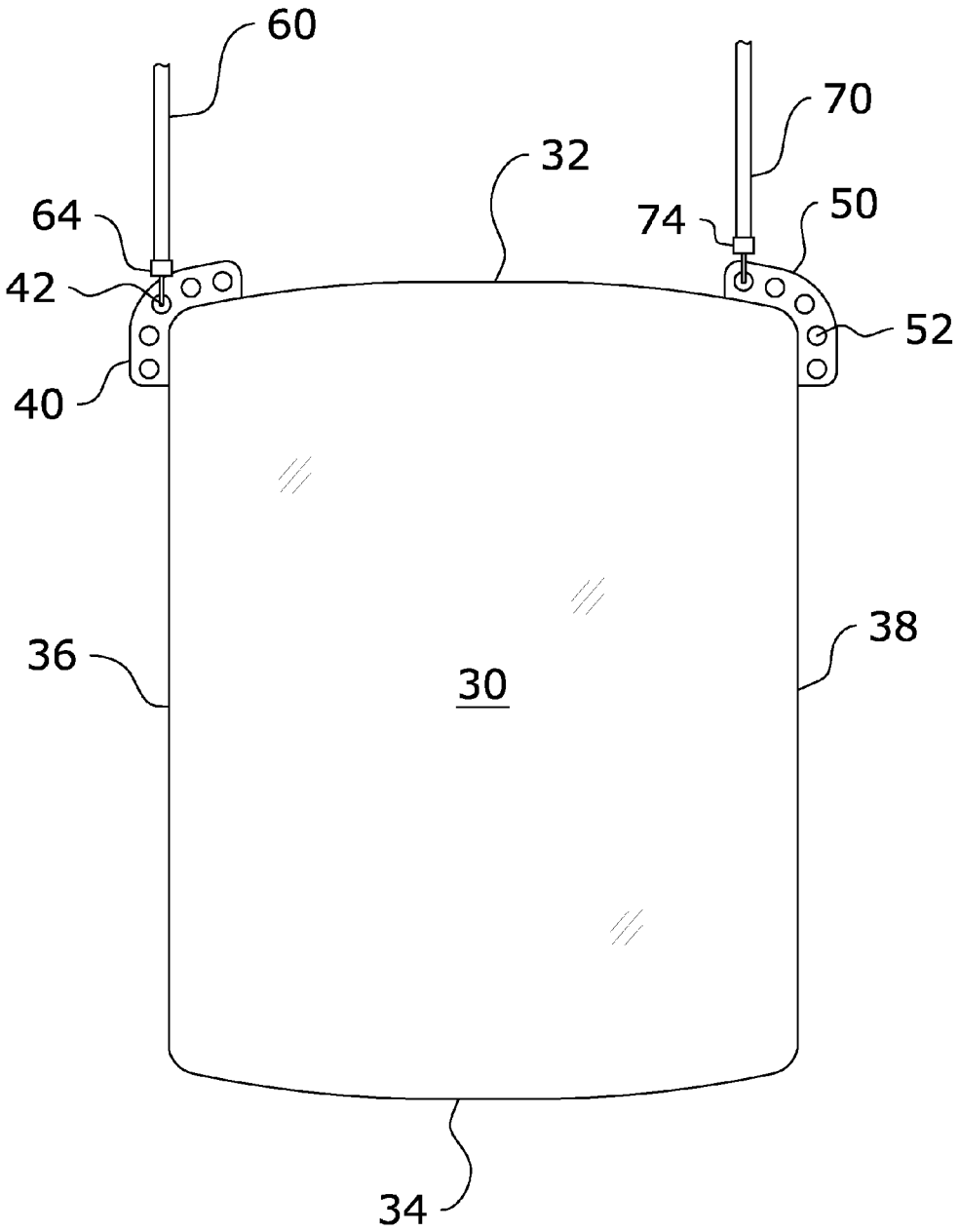
FIG. 5 is a top view of the carriage with the first cable connected to a middle length position on the first connector and with the second cable connected to the shortest length position.

The carriage 30 movably positioned upon the frame 22 to move between the first distal end and the second distal end of the frame 22 along at least a portion of the longitudinal axis. The carriage 30 includes an upper surface, a lower surface, a first end 32 facing towards the first distal end of the frame 22, a second end 34 facing the second distal end of the frame 22, a first side 36, a second side 38 opposite of the first side 36 as best illustrated in FIGS. 3 through 5 of the drawings. The carriage 30 is generally a relatively flat structure with the lower surface parallel with respect to the support rails 24*a-b*. During an exercise, the exerciser positions their body upon the upper surface of the carriage 30 and then by pulling upon the cables causes the carriage 30 to move towards the first distal end of the frame 22 with the biasing members 21 applying a counterforce to the movement towards the first distal end of the frame 22.

Figure 6:
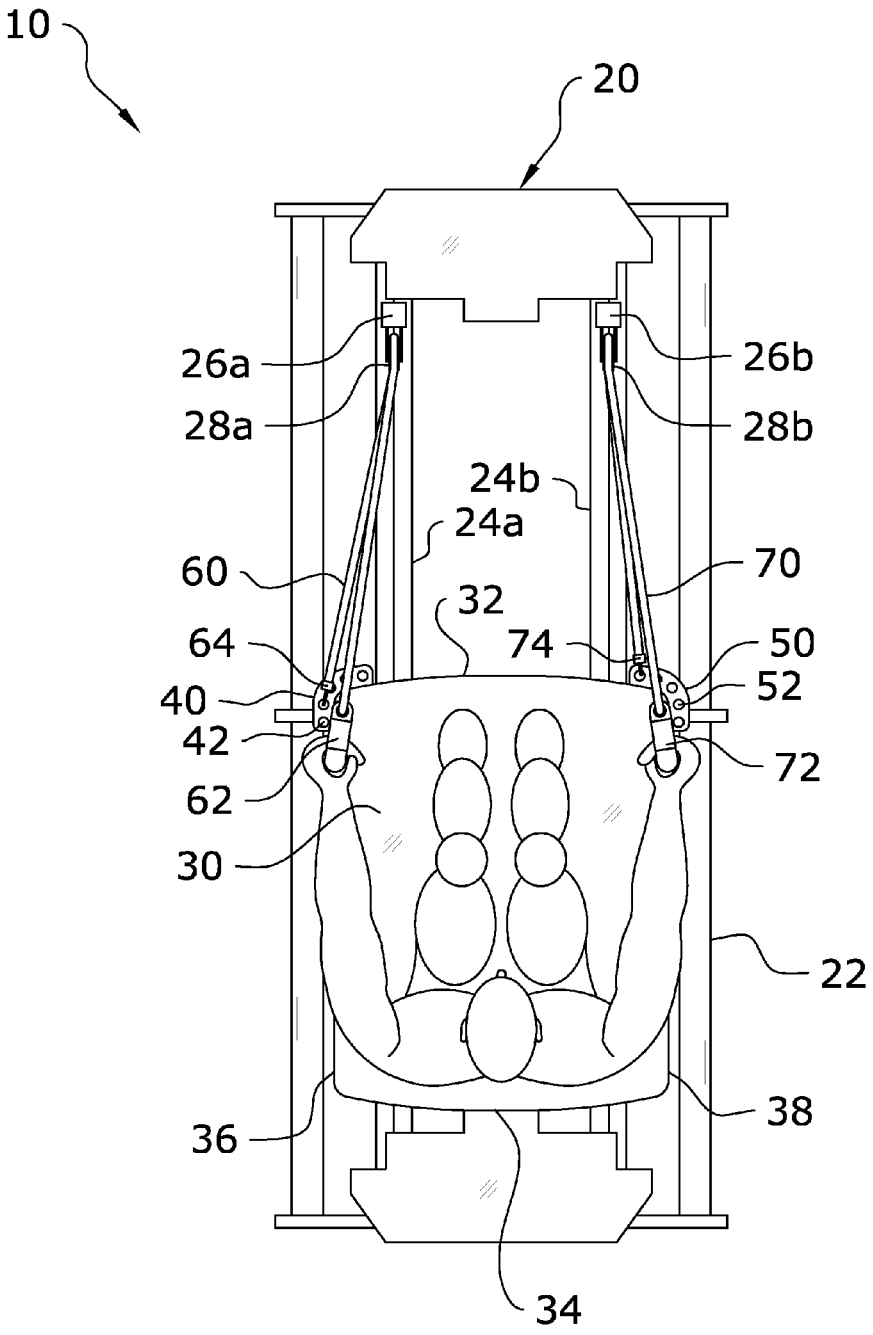
FIG. 6 is a top view of the present invention with the carriage in the initial position near a first end of the exercise machine with the cables connected in the same positions as illustrated in FIG. 5.
Figure 7:
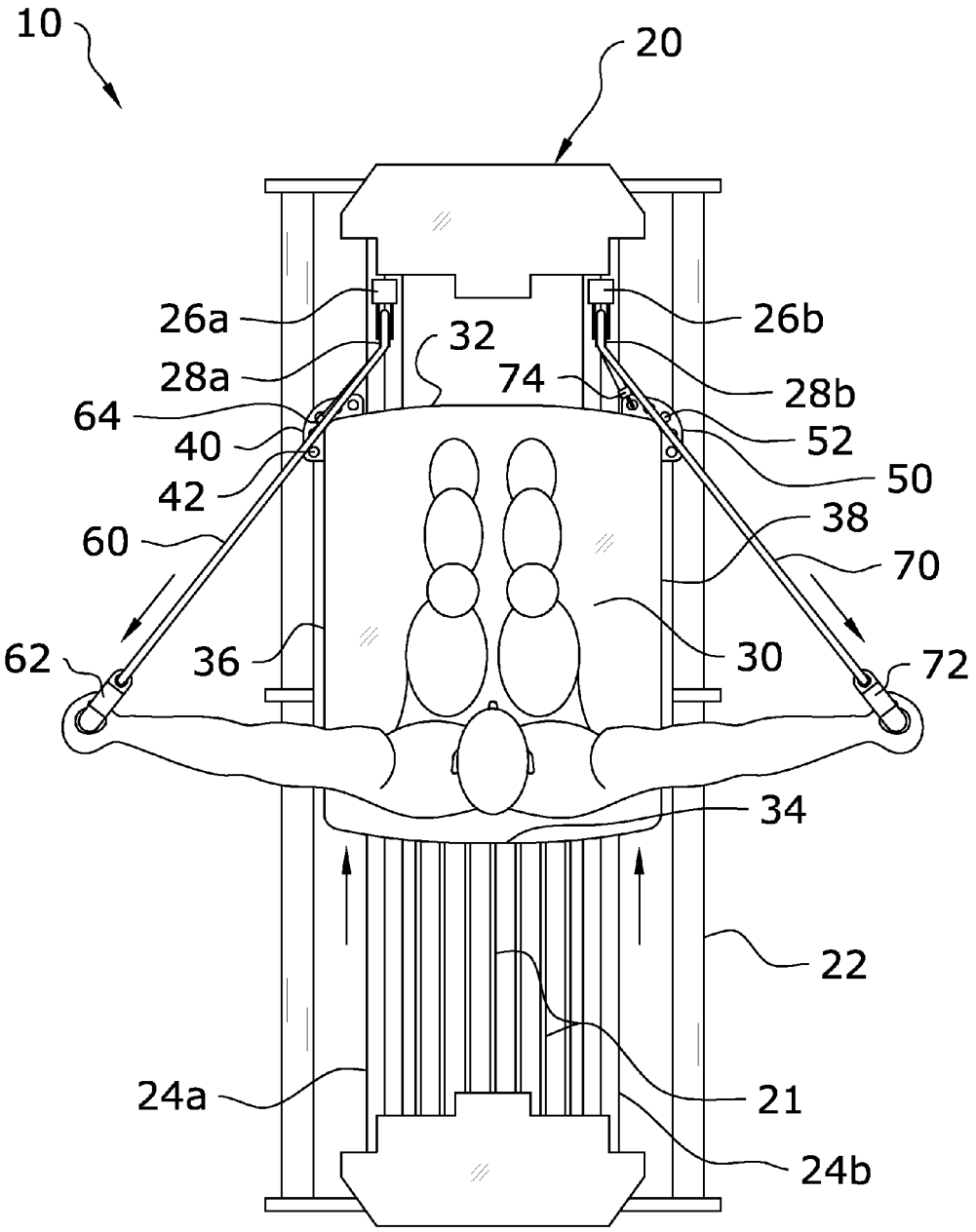
FIG. 7 is a top view of the present invention with the carriage in the initial position near a first end of the exercise machine with the cables connected in the same positions as illustrated in FIG. 5.

The carriage 30 may have various shapes, sizes and configurations. FIGS. 3 through 5 illustrate an exemplary shape for the upper surface of the carriage 30 having a generally rectangular structure with rounded corners along with a slightly convex first end 32 and second end 34. The upper portion of the carriage 30 is preferably comprised of a resilient gripping material such as a padded rubber covering. The carriage 30 is further preferably centrally aligned with a center longitudinal axis of the frame 22. The carriage 30 is also preferably centrally aligned with the pulleys 28*a-b* to that an individual centrally sitting upon the carriage 30 will be centered with respect to the pulleys 28*a-b* during an exercise as illustrated in FIGS. 6 and 7 of the drawings.

D. Cable and Pulley System

The present invention utilizes a cable and pulley system to allow an individual to cause movement of the carriage 30 along the longitudinal axis of the frame 22. The cable and pulley system of the present invention may be comprised of a single cable 60 but it is preferable to have two cables that are connected on opposing portions of the carriage 30 and movably supported on opposing sides of the frame 22. The discussion herein will discuss the usage of two cables but this should not limit the number of cables used on the present invention.

Figure 2:
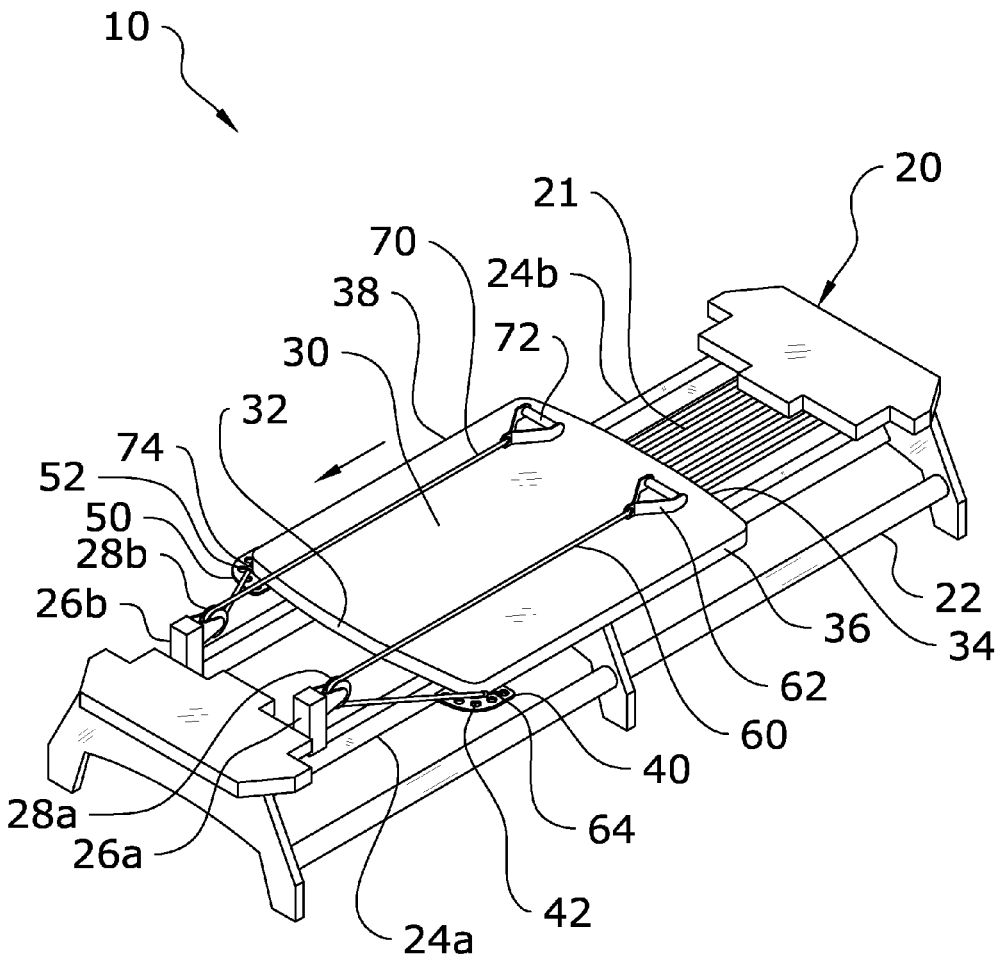
FIG. 2 is an upper perspective view of the present invention with the cables extended pulling the carriage towards one end of the exercise machine.
Figure 8:
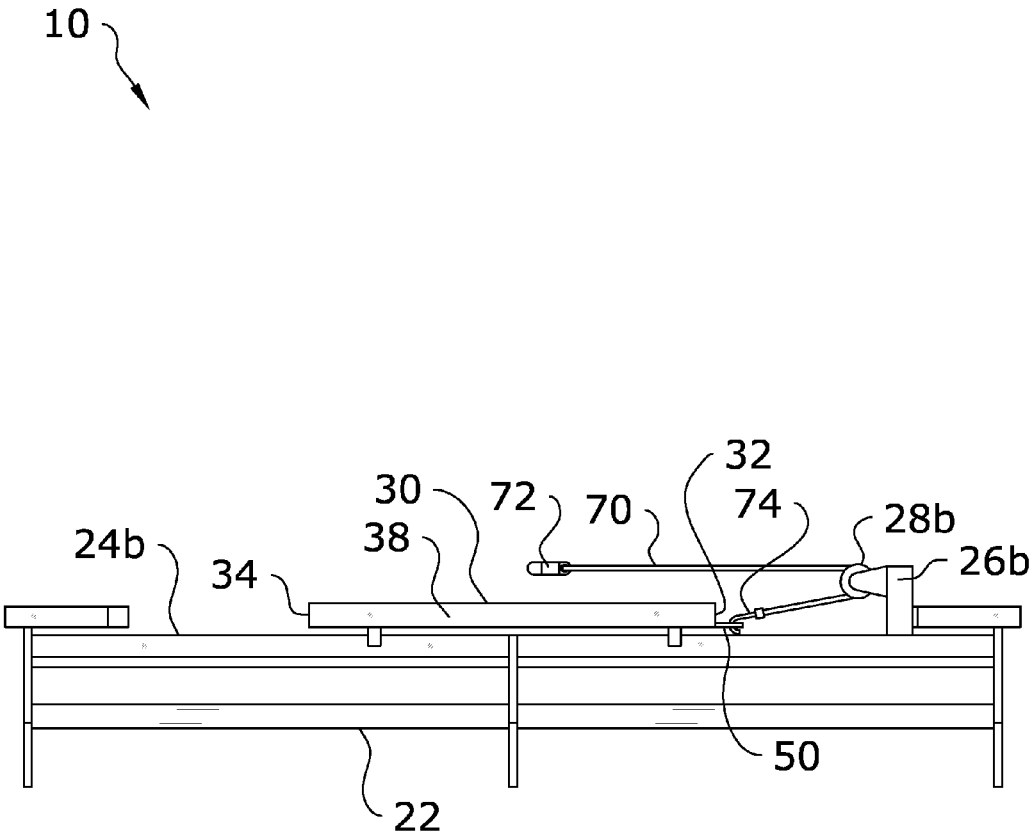
FIG. 8 is a side view of the present invention.
Figure 9:
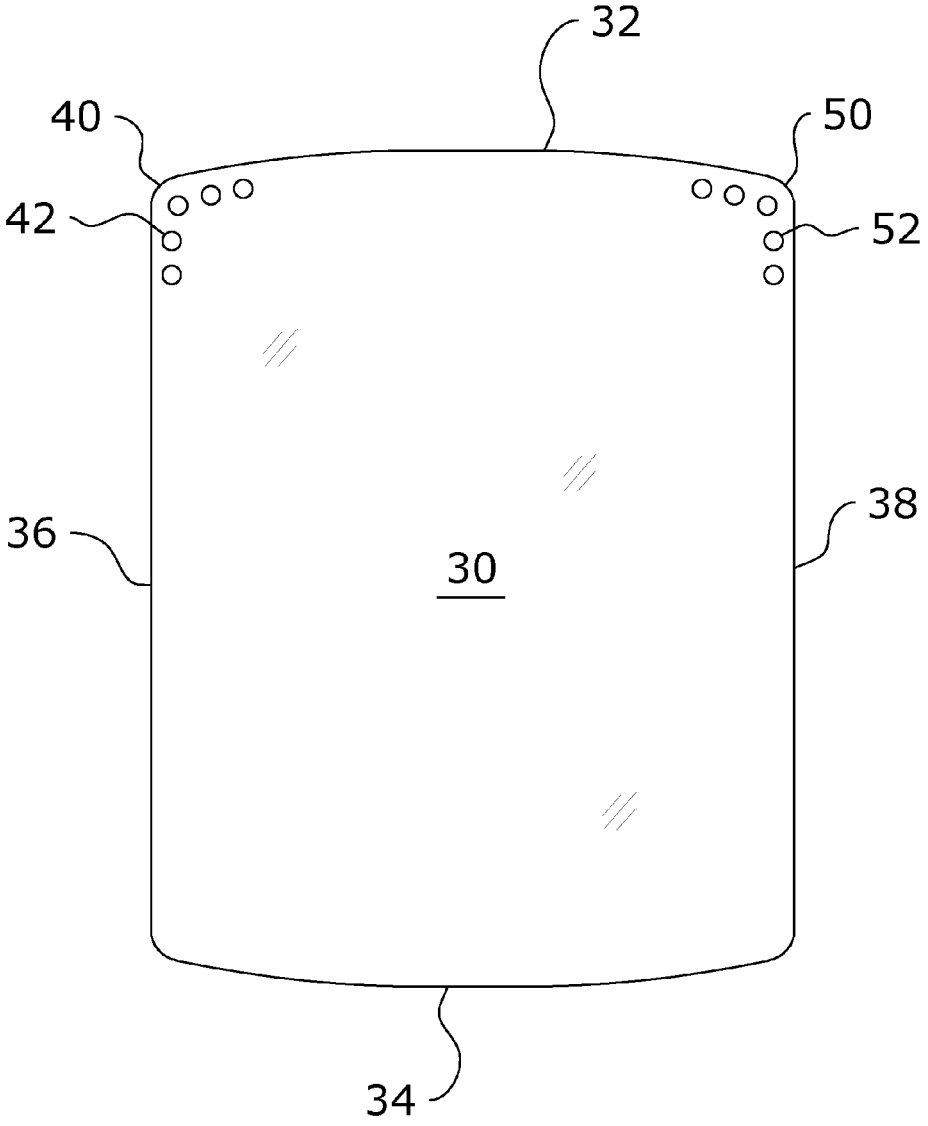
FIG. 9 is a top view of the carriage with the connectors comprised of holes within the carriage.

The cable and pulley system includes a first pulley 28*a* and a second pulley 28*b* 28*a-b* connected to the frame 22 between the first distal end and the first end 32 of the carriage 30. The pulleys 28*a-b* are directly connected to the frame 22 or indirectly connected to the frame 22 via stanchions 26*a-b* as illustrated in FIGS. 1 and 2 of the drawings. The pulleys 28*a-b* are preferably equidistantly positioned on opposing sides of a center longitudinal axis of the frame 22 to maintain the proper centering and positioning of the exerciser with respect to the pulleys 28*a-b*. The pulleys 28*a-b* may pivot inwardly or outwardly to accommodate the varying angles of the cables during an exercise. The pulleys 28*a-b* are preferably positioned at or near the first distal end of the frame 22 as illustrated in FIGS. 6 through 8 of the drawings. The cables are movably positioned upon the pulleys 28*a-b*.

The first cable 60 includes a first engaging end 62 adapted for engagement by an exerciser and a first engaging member 64 opposite of the first engaging end 62 that is connected to the carriage 30. The first engaging end 62 may be comprised of a handle, a strap, a looped strap, a first foot strap or other device capable of being engaged by the hands, arms, feet and/or legs of the exerciser to cause movement of the first cable 60.

The first cable 60 may be comprised of any elongated flexible structure that has a length and capable of being used upon the first pulley 28*a*. The first cable 60 may be constructed of various material types. For example, the first cable 60 may be comprised of a length of rope, wire rope (coated or uncoated), straps, or belting (e.g. KEVLAR belting). The first cable 60 may have various thicknesses and flexibility commonly utilized with Pilates machines. The first cable 60 is preferably not stretchable or elastic.

The first cable 60 has a first length between the first engaging end 62 and the first engaging member 64. The first length may vary based upon the size of the exercise machine 20, age of the first cable 60, wearing of the first cable 60 and/or the amount of usage of the first cable 60. Over time during usage, the first cable 60 may extend or contract in length. The present invention allows for adjustment of the effective length of the first cable 60 to ensure that the exerciser is always centered and symmetrical with respect to the cables during an exercise.

The first cable 60 includes a first run between the first pulley 28*a* and the carriage 30 as illustrated in FIGS. 1 and 2 of the drawings. The first cable 60 continues to wrap around the first pulley 28*a* wherein the first cable 60 includes a second run between the first pulley 28*a* and the first engaging end 62 of the first cable 60. The first length of the first cable 60 is equal to the first run plus the second run added together. For example, if the first run has a length of 3 feet and the second run has a length of 4 feet, the first length of the first cable 60 is 7 feet. As the user exercises and pulls upon the second run of the first cable 60, the second run increases in length and the first run correspondingly decreases in length as illustrated in FIGS. 6 and 7 of the drawings.

The first engaging member 64 is adapted to be adjustably connected to the carriage 30 in one of a plurality of positions. Each of the positions the first engaging member 64 is connectable to preferably provides a different length for the first run of the first cable 60. The plurality of positions include at least a first position (e.g. shortest length position) and a last position (e.g. a longest length position). When the first engaging member 64 is connected to the shortest length position the first run is shorter than when the first engaging member 64 is connected to the longest length position. There may be any number of middle positions between the first position and the last position (e.g. 0, 1, 2, 3, 4) which provide a length for the first run of the first cable 60 that is between the lengths created by the first position and the last position. FIGS. 3 through 5 illustrate the usage of 5 different positions for the first engaging member 64 to connect to with each of the positions providing a different length for the first run of the first cable 60. The longest length position on the carriage 30 is positioned a first distance from the first pulley 28*a* and the shortest length position is positioned a second distance from the first pulley 28*a*, wherein the first distance is longer than the second distance thereby providing a corresponding difference for the first run of the first cable 60.

The second cable 70 preferably is identical or similar to the first cable 60 (e.g. length, width, flexibility, material type, etc.). It is preferable that the first cable 60 and the second cable 70 have the same length. However, the present invention is designed to accommodate the usage of a first cable 60 that has a different length (e.g. shorter or longer) than the second cable 70 via the adjustment system thereby maintaining a centered position for the exerciser during the exercise movement.

The second cable 70 includes a second engaging end 72 adapted for engagement by an exerciser and a second engaging member 74 opposite of the second engaging end 72 that is connected to the carriage 30. The second engaging end 72 may be comprised of a handle, a strap, a looped strap, a second foot strap or other device capable of being engaged by the hands, arms, feet and/or legs of the exerciser to cause movement of the second cable 70.

The second cable 70 may be comprised of any elongated flexible structure that has a length and capable of being used upon the second pulley 28*b*. The second cable 70 may be constructed of various material types. For example, the second cable 70 may be comprised of a length of rope, wire rope (coated or uncoated), straps, or belting (e.g. KEVLAR belting). The second cable 70 may have various thicknesses and flexibility commonly utilized with Pilates machines. The second cable 70 is preferably not stretchable or elastic.

The second cable 70 has a second length between the second engaging end 72 and the second engaging member 74. The second length may vary based upon the size of the exercise machine 20, age of the second cable 70, wearing of the second cable 70 and/or the amount of usage of the second cable 70. Over time during usage, the second cable 70 may extend or contract in length. The present invention allows for adjustment of the effective length of the second cable 70 to ensure that the exerciser is always centered and symmetrical with respect to the cables during an exercise.

The second cable 70 includes a first run between the second pulley 28*b* and the carriage 30 as illustrated in FIGS. 1 and 2 of the drawings. The first run of the first cable 60 may be different than the first run of the second cable 70.

The second cable 70 continues to wrap around the second pulley 28*b* wherein the second cable 70 includes a second run between the second pulley 28*b* and the second engaging end 72 of the second cable 70. The second run of the first cable 60 is preferably equal in length to the second run of the second cable 70 thereby ensuring that the portions of the cables engaged by the user have the same length from the pulleys 28*a-b* to the user.

The second length of the second cable 70 is equal to the first run plus the second run added together. For example, if the first run has a length of 3 feet and the second run has a length of 4 feet, the second length of the second cable 70 is 7 feet. As the user exercises and pulls upon the second run of the second cable 70, the second run increases in length and the first run correspondingly decreases in length as illustrated in FIGS. 6 and 7 of the drawings.

The second engaging member 74 is adapted to be adjustably connected to the carriage 30 in one of a plurality of positions. The plurality of positions for the second engaging member 74 preferably mirror the plurality of positions for the first engaging member 64. Each of the positions the second engaging member 74 is connectable to preferably provides a different length for the second run of the second cable 70. The plurality of positions include at least a first position (e.g. shortest length position) and a last position (e.g. a longest length position). When the second engaging member 74 is connected to the shortest length position the first run is shorter than when the second engaging member 74 is connected to the longest length position. There may be any number of middle positions between the second position and the last position (e.g. 0, 1, 2, 3, 4) which provide a length for the first run of the second cable 70 that is between the lengths created by the second position and the last position. FIGS. 3 through 5 illustrate the usage of 5 different positions for the second engaging member 74 to connect to with each of the positions providing a different length for the first run of the second cable 70. The longest length position on the carriage 30 is positioned a second distance from the second pulley 28*b* and the shortest length position is positioned a second distance from the second pulley 28*b*, wherein the second distance is longer than the second distance thereby providing a corresponding difference for the first run of the second cable 70. The second run of the first cable 60 is preferably equal in length to the second run of the second cable 70.

The plurality of positions for the first engaging member 64 and the second engaging member 74 are preferably comprised of first eyelets 42 and second eyelets 52 respectively within the carriage 30. The first engaging member 64 and the second engaging member 74 selectively each engage one of the first eyelets 42 and second eyelets 52. The first eyelets 42 are preferably positioned on a side of the carriage 30 opposite of the second eyelets 52 equidistantly spaced from the center longitudinal axis of the frame 22.

The number of first eyelets 42 is preferably the same as the number of second eyelets 52, but the number may differ. The positions of the first eyelets 42 preferably mirrors the positions of the second eyelets 52 as illustrated in FIGS. 3 through 5 of the drawings. The first eyelets 42 and the second eyelets 52 are further preferably not positioned inwardly with respect to the corresponding pulleys 28*a-b* and instead are preferably positioned outwardly with respect to the corresponding pulleys 28*a-b* as illustrated in FIGS. 6 and 7 of the drawings.

The increase or decrease in distance from the pulleys 28*a-b* for the eyelets 42, 52 may increase various amounts (e.g. 0.1 inches, 0.2 inches, 0.3 inches, 0.4 inches, 0.5 inches) thereby allowing the user to accurately adjust the length of the second run of the cables. The distance gained or lost to the pulleys 28*a-b* for each of the cables may be the same or vary. The distance gained or lost to the pulleys 28*a-b* from the carriage 30 for the first run of the cables varies based on the position with the distance increasing more as the eyelets 42, 52 on the sides 36, 38 of the carriage 30 are used.

The first eyelets 42 and the second eyelets 52 preferably are positioned near the first end 32 and/or the sides 36, 38 of the carriage 30. The eyelets 42, 52 may extend through the portions of the carriage 30 the user positions their body upon or through an extended structure such as the connectors 40, 50.

The first engaging member 64 and the second engaging member 74 may be comprised of any structure capable of catchably engaging the carriage 30. The first engaging member 64 and the second engaging member 74 are illustrated as having a hook structure to allow for convenient removal and attachment to the various eyelets 42, 52. The first engaging member 64 and the second engaging member 74 are inserted in a catchable manner into the eyelets 42, 52 which allows for removal and adjustment thereof based on the current length of the second run of the corresponding cable 60, 70.

E. Connectors

The carriage 30 includes a first connector 40 near the first side 36 and a second connector 50 near the second side 38. The first engaging member 64 is adjustably connected to the first connector 40 and the second engaging member 74 is adjustably connected to the second connector 50 as illustrated in FIGS. 4 and 5 of the drawings. The connectors 40, 50 may be comprised of a single structure or two separate structures. The connectors 40, 50 preferably mirror one another to provide for a consistent adjustment structure that provides the same increase or decrease in the length of the second run of the cable 60, 70.

The first connector 40 includes a plurality of first eyelets 42 that the first engaging member 64 selectively engages and the second connector 50 includes a plurality of second eyelets 52 that the second engaging member 74 selectively engages. The first connector 40 and the second connector 50 may be comprised of a bracket extending outwardly from the carriage 30. FIGS. 3 through 5 illustrate an L-shaped bracket structure for the connectors 40, 50. The bracket may be comprised of a plate structure or other type of structure with the eyelets 42, 52 extending vertically, horizontally or at an angle through.

The connectors 40, 50 extend preferably outwardly from the first end 32 and/or the sides 36, 38 of the carriage 30 as illustrated in FIGS. 3 through 5 of the drawings. The connectors 40, 50 preferably extend about the opposing corners of the first end 32 of the carriage 30 as illustrated in FIGS. 3 through 5 of the drawings. The connectors 40, 50 are preferably comprised of an outwardly curved structure that extends outwardly from the corners of the carriage 30.

F. Operation of Preferred Embodiment

In use, the user connects the first run for each of the cables to the same position on the respective connector 40, 50 assuming that the cables each have the same length as illustrated in FIG. 4 of the drawings. The user then pulls the cables taught so that the second runs aligned to determine if one of the cables are longer/shorter than the other and then adjust the same accordingly so the second runs of the cables are the same length.

For example, if the second run of the first cable 60 is longer than the second run of the second cable 70, the user would move the first engaging member 64 to the next position that increases the length of the first run and decreases the length of the second run of the first cable 60. The user then compares the respective lengths of the second runs of the cables again. If the second runs are now equal, the user does not make any further adjustments. However, if the second run of the first cable 60 is still longer, the user then moves the first engaging member 64 to the next position that increases the length of the first run and decreases the length of the second run of the first cable 60. This process continues until the lengths of the second runs of the cables are equal to one another. Because the initial inward positions of the eyelets 42, 52 provide a smaller incremental change in length than the outer eyelets, if the second run of the first cable 60 becomes slightly shorter than the second run of the second cable 70 during adjustment, the user may move the second engaging member 74 by a position to slightly shorten the second run of the second cable 70. After the second runs of the cables are equal, the individual is able to use the exercise machine 20 in an effective manner without one side of their body encountering more stress than the other side of their body when centered.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An exercise machine, comprising:

a frame having a first end, a second end opposite of the first end, and a longitudinal axis extending therebetween;

a carriage movably positioned upon the frame, wherein the carriage is adapted to be movable along a portion of the longitudinal axis, wherein the carriage includes an upper surface, a first end facing towards the first end of the frame, a first side, and a second side opposite of the first side;

a first pulley connected to the frame;

a first cable movably positioned upon the first pulley, wherein the first cable includes a first engaging end adapted for engagement by an exerciser, a second engaging end opposite of the first engaging end connected to the carriage, a first length between the first engaging end and the second engaging end, a first run between the first pulley and the carriage, and a second run between the first pulley and the first engaging end; and a first connector attached directly to or formed within the carriage comprising a first set of holes configured for selective adjustable attachment of the second engaging end, wherein the first set of holes is positioned such that, when the second engaging end is connected to a first hole of the first set of holes, the first run is shorter than when the second engaging end is connected to a second hole of the first set of holes.

2. The exercise machine of claim 1, wherein the first connector is comprised of a bracket.

3. The exercise machine of claim 2, wherein the bracket is comprised of a plate structure.

4. The exercise machine of claim 2, wherein the first connector extends outwardly from the first end of the carriage.

5. The exercise machine of claim 2, wherein the first connector extends outwardly from the first side of the carriage.

6. The exercise machine of claim 1, wherein the first connector is comprised of a curved structure that extends outwardly from a first corner of the carriage.

7. The exercise machine of claim 1, wherein the first connector is attached directly to the carriage.

8. The exercise machine of claim 7, wherein the first connector extends outwardly from the carriage.

9. The exercise machine of claim 8, wherein the first connector extends outwardly from a first side of the carriage.

10. The exercise machine of claim 1, wherein the first connector extends outwardly from a first end of the carriage.

11. The exercise machine of claim 1, wherein the first connector is comprised of a bracket that is substantially parallel with respect to the upper surface of the carriage.

12. The exercise machine of claim 1, wherein the first connector is positioned near a first corner of the carriage.

13. The exercise machine of claim 1, wherein the first connector is formed within the carriage.

14. The exercise machine of claim 13, wherein the first set of holes extend through a portion of the carriage.

15. The exercise machine of claim 1, comprising:

a second pulley connected to the frame between the first end of the frame and the first end of the carriage;

a second cable movably positioned upon the second pulley, wherein the second cable includes a first engaging end adapted for engagement by an exerciser, a second engaging end opposite of the first engaging end connected to the carriage, a first length between the first engaging end and the second engaging end of the second cable, a first run between the second pulley and the carriage, and a second run between the second pulley and the first engaging end of the second cable; and a second connector attached directly to or formed within the carriage comprising a second set of holes configured for selectively adjustable attachment of the second engaging end of the second cable, wherein the second set of holes is positioned such that, when the second engaging end of the second cable is connected to a first hole of the second set of holes, the first run is shorter than when the second engaging end of the second cable is connected to a second hole of the second set of holes.

16. The exercise machine of claim 15, wherein the first connector is positioned near a first corner of the carriage and the second connector is positioned near a second corner of the carriage opposite of the first corner.

17. The exercise machine of claim 1, wherein the first engaging end is comprised of a handle.

18. The exercise machine of claim 1, wherein the second engaging end is comprised of a hook structure.

19. The exercise machine of claim 1, wherein the second engaging end is adapted to be insertable in a catchable manner into one of the first set of holes.

20. The exercise machine of claim 1, wherein the first set of holes includes a third hole, wherein when the second engaging end is connected to a third hole of the first set of holes, the first run is longer than when the second engaging end is connected to the second hole of the first set of holes.

21. The exercise machine of claim 1, wherein the first pulley is connected to the frame between the first end of the frame and the first end of the carriage, wherein the first hole is closer to the first end of the frame than the second hole.

22. The exercise machine of claim 1, wherein the first set of holes is positioned on a substantially curved path.

23. An exercise machine, comprising:

a frame having a first end, a second end opposite of the first end, and a longitudinal axis extending therebetween;

a carriage movably positioned upon the frame, wherein the carriage is adapted to be movable along a portion of the longitudinal axis, wherein the carriage includes an upper surface, a first end facing towards the first end of the frame, a first side, and a second side opposite of the first side;

a first pulley connected to the frame;

a first cable movably positioned upon the first pulley, wherein the first cable includes a first engaging end adapted for engagement by an exerciser, a second engaging end opposite of the first engaging end connected to the carriage, a first run between the first pulley and the carriage, and a second run between the first pulley and the first engaging end;

a first connector extending from the carriage comprising a first set of holes configured for selective adjustable attachment of the second engaging end, wherein the first set of holes is positioned such that, when the second engaging end is connected to a first hole of the first set of holes, the first run is shorter than when the second engaging end is connected to a second hole of the first set of holes;

a second pulley connected to the frame;

a second cable movably positioned upon the second pulley, wherein the second cable includes a first engaging end adapted for engagement by an exerciser, a second engaging end opposite of the first engaging end connected to the carriage, a first run between the second pulley and the carriage, and a second run between the second pulley and the first engaging end of the second cable; and a second connector extending from the carriage comprising a second set of holes configured for selectively adjustable attachment of the second engaging end of the second cable, wherein the second set of holes is positioned such that, when the second engaging end of the second cable is connected to a first hole of the second set of holes, the first run is shorter than when the second engaging end of the second cable is connected to a second hole of the second set of holes.

24. The exercise machine of claim 23, wherein the first connector and the second connector are directly attached to the carriage.

25. The exercise machine of claim 23, wherein the first connector and the second connector are each comprised of brackets.

26. The exercise machine of claim 25, wherein the first connector and the second connector are substantially parallel with respect to the upper surface of the carriage.

27. The exercise machine of claim 23, wherein the first connector is comprised of a curved structure that extends outwardly from a first corner of the carriage.

28. The exercise machine of claim 23, wherein the first connector is positioned near a first corner of the carriage and the second connector is positioned near a second corner of the carriage.

29. The exercise machine of claim 23, wherein the second engaging ends of the first cable and the second cable are each comprised of a hook structure.

30. The exercise machine of claim 23, wherein the second engaging end of the first cable is adapted to be insertable in a catchable manner into one of the first set of holes, and wherein the second engaging end of the second cable is adapted to be insertable in a catchable manner into one of the second set of holes.

31. The exercise machine of claim 23, wherein the first pulley and the second pulley are connected to the frame between the first end of the frame and the first end of the carriage, wherein the first holes of the first connector and the second connector are closer to the first end of the frame than the second holes of the first connector and the second connector.

32. The exercise machine of claim 23, wherein the first set of holes is positioned on a substantially curved path.

33. An exercise machine, comprising:

a frame having a first end, a second end opposite of the first end, and a longitudinal axis extending therebetween;

a carriage movably positioned upon the frame, wherein the carriage is adapted to be movable along a portion of the longitudinal axis, wherein the carriage includes an upper surface, a first end facing towards the first end of the frame, a first side, and a second side opposite of the first side;

a first pulley connected to the frame between the first end of the frame and the first end of the carriage;

a first cable movably positioned upon the first pulley, wherein the first cable includes a first engaging end adapted for engagement by an exerciser, a second engaging end opposite of the first engaging end connected to the carriage, a first run between the first pulley and the carriage, and a second run between the first pulley and the first engaging end;

a first connector extending from the carriage comprising a first set of holes configured for selective adjustable attachment of the second engaging end, wherein the first set of holes is positioned such that, when the second engaging end is connected to a first hole of the first set of holes, the first run is shorter than when the second engaging end is connected to a second hole of the first set of holes, wherein the first hole of the first connector is closer to the first end of the frame than the second hole of the first connector, and wherein the second engaging end of the first cable is adapted to be insertable in a catchable manner into one of the first set of holes;

a second pulley connected to the frame between the first end of the frame and the first end of the carriage;

a second cable movably positioned upon the second pulley, wherein the second cable includes a first engaging end adapted for engagement by an exerciser, a second engaging end opposite of the first engaging end connected to the carriage, a first run between the second pulley and the carriage, and a second run between the second pulley and the first engaging end of the second cable; and a second connector extending from the carriage comprising a second set of holes configured for selectively adjustable attachment of the second engaging end of the second cable, wherein the second set of holes is positioned such that, when the second engaging end of the second cable is connected to a first hole of the second set of holes, the first run is shorter than when the second engaging end of the second cable is connected to a second hole of the second set of holes, wherein the first hole of the second connector is closer to the first end of the frame than the second hole of the second connector, wherein the second engaging end of the second cable is adapted to be insertable in a catchable manner into one of the second set of holes.

34. The exercise machine of claim 33, wherein the first connector and the second connector are directly attached to the carriage.

35. The exercise machine of claim 33, wherein the first connector and the second connector are each comprised of brackets.

36. The exercise machine of claim 33, wherein the first connector is positioned near a first corner of the carriage and the second connector is positioned near a second corner of the carriage.

37. The exercise machine of claim 33, wherein the second engaging ends of the first cable and the second cable are each comprised of a hook structure.

* * * * *